United States Patent [19]

Jacobs

[11] 4,254,889

[45] Mar. 10, 1981

[54] POP TOP CAN SEALER

[76] Inventor: Harvey B. Jacobs, 11607 Foxclove Rd., Reston, Va. 22091

[21] Appl. No.: 102,566

[22] Filed: Dec. 11, 1979

[51] Int. Cl.[3] ..... B65D 53/00

[52] U.S. Cl. ..... 220/234; 220/238; 215/358

[58] Field of Search ..... 220/234, 237, 238, 281; 215/358, 359, 361, 270, 364

[56] References Cited

U.S. PATENT DOCUMENTS

| | | | |
|---|---|---|---|
| 3,326,403 | 6/1967 | Glass | 220/234 |
| 3,876,102 | 4/1975 | Wharton | 215/358 |
| 4,083,468 | 4/1978 | Batcheher | 220/238 |
| 4,214,672 | 7/1980 | Peniche | 220/234 |

*Primary Examiner*—George T. Hall

*Attorney, Agent, or Firm*—Bennett A. Brown

[57] ABSTRACT

A closure for use with can-type containers, having an opening formed in one end by removing a portion of the container material. The closure has a vertical sidewall, forming a chamber within which a hermetically sealed elastic membrane is fastened, and an actuator plate resting within the vertical walls on the upper surface of the hermetically sealed membrane so that by downward movement of the actuator plate the membrane is forced to expand within the container opening, and with further downward movement of the actuator plate expands inside the container to provide a seal.

7 Claims, 5 Drawing Figures

POP TOP CAN SEALER

BACKGROUND OF THE INVENTION

This invention relates generally to closures for containers having "pop top" openings in one end, and more particularly to such containers used for packaging carbonated drinks or food products.

Heretofore, the use of "pop top" containers to package food products or drinks required the consumer to use all of the contents or to transfer the unused portion to other containers for resealing. Such a procedure was necessary if the consumer were to maintain the original flavor of the contents of the container since the opened top would allow escape of some of the flavor as well as allowing odors of other stored food products to invade the container. Further, the open top can is prone to spillage. If the original contents are carbonated, the open can or container allows the escape of the carbon dioxide gas, producing a flat or stale taste in the remaining portion of the drink.

SUMMARY OF THE INVENTION

In accordance with the invention, the closure is provided with a chamber which is defined by vertical walls of light-weight plastic or metal. The shape of the closure, in plan form, is generally rectangular, with one short end of the rectangular shape curved with the same radius as various standard size containers, so that the closure will fit within the flange of the container. The upper edge on the vertical walls are turned inward to form a flange completely surrounding the upper open end of the chamber. Within the chamber there is a hermetically sealed elastic membrane or "balloon" affixed to the chamber by a circumferential flange. The balloon is of the same general shape as the chamber, though it extends downwardly somewhat below the lower edge of the chamber walls. The balloon is inflated with an inert fluid, either gas or liquid. An actuator plate is located within the chamber, between the upper surface of the balloon and the inward circumferential flange, located at the upper edge of the chamber vertical walls. The actuator plate is the same shape as the chamber, although it is slightly smaller in plan form, to provide easy sliding movement within the chamber.

In order to use the device, one merely places the closure over the opening made in a "pop top" can. While holding the closure firmly against the top of the container, the actuator plate is displaced downwardly, thereby displacing the contents of the balloon from within the walls of the closure chamber and into the container where the balloon occupies the space of the expelled contents. The expansion of the elastic membrane within the container creates a seal around the interior edge of the opening made by the "pop top". The actuator plate is held in the downwardly displaced position by engaging ribs located on the inside of the chamber walls. These locking ribs are engaged by moving the actuator plate in the horizontal place.

To release the seal made by the elastic membrane, the actuator plate of the closure is depressed slightly then moved out of engagement with the ribs in the horizontal place. The elastic membrane will displace itself back into the chamber and the closure can be removed from the container.

It is, therefore, an object of the invention to produce a closure which can be used to reseal "pop top" cans.

It is also an object of the invention to provide a container having a permanently formed opening in one end thereof with a closure membrane forming an inflated seal about the permanently formed opening.

DETAILED DESCRIPTION

Figure 1:
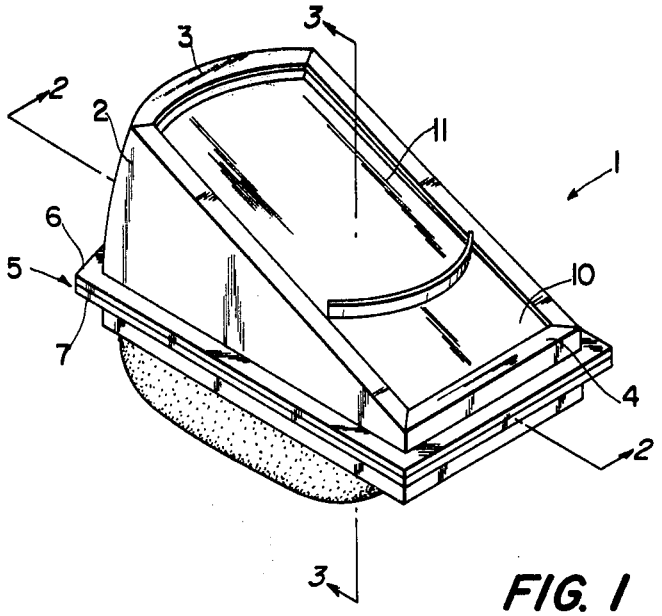
FIG. 1 is a perspective view of the closure in accordance with the present invention.
Figure 2:
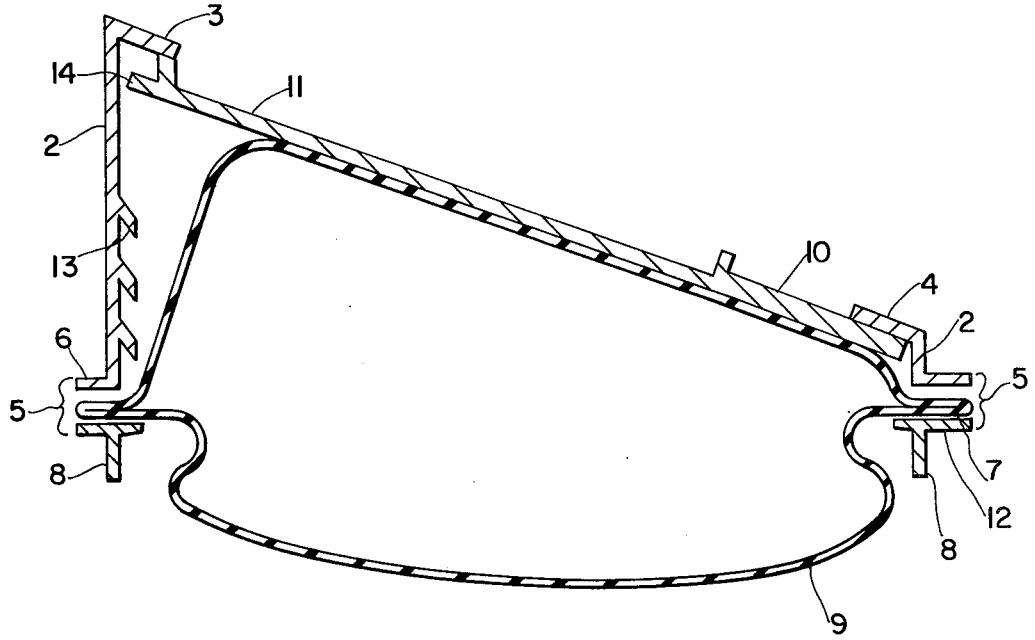
FIG. 2 is a sectional view of said container taken along the line 2—2 of FIG. 1.
Figure 3:
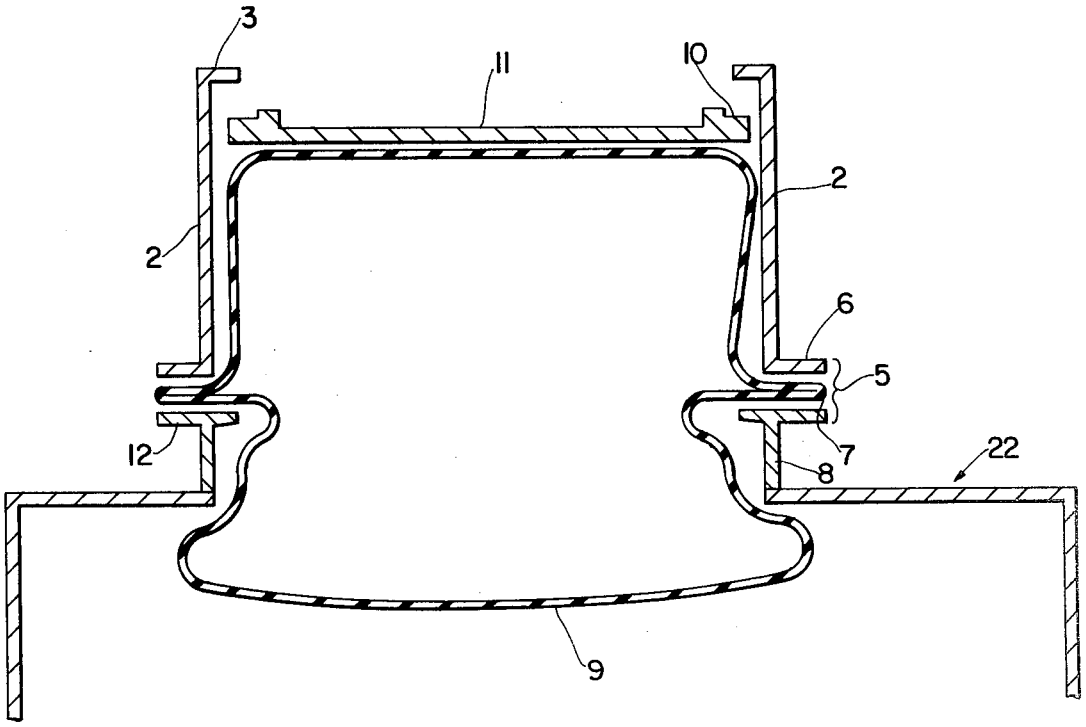
FIG. 3 is a sectional view of said closure taken along the line 3—3 of FIG. 1.

Referring now to the drawing, and in particular to the first embodiment of the invention illustrated in FIGS. 1–3, the closure, 1, may comprise a pyramidal shaped plastic or light-weight metal housing with a generally rectangular plan form, forming a chamber having vertical sidewalls, 2, extending from a ceiling flange, 5, upwardly to a inturned flange, 3. Along the apex edge of the pyramidal shaped closure the inwardly turned flange, 4, serves as a retainer and pivot plane for the actuator plate, 10.

The seal, 5, extends around the complete circumference of the closure and is formed by affixing together the outwardly turned flange, 6, of the sidewalls to, an integral flange portion, 7, of the elastic membrane, 9, and the outwardly turned flange, 12, of the lower sidewall, 8. The seal, 5, is effected by any suitable method including heat and pressure, glue, staple. The seal, 5, may be either permanent or capable of being disassembled and reassembled.

The lower wall, 8, forms the circumference of the opening in the closure, which is placed against the container, 22, to be sealed. The lower wall, 8, is of a height somewhat less than the rim of the container to be sealed. The lower wall, 8, also has an interior flange, 21, located at the upper edge thereof. The internal flange, 21, is a guide for the elastic membrane, 9. The opening circumscribed by this flange, 21, is slightly wider and slightly longer than the coordinate dimensions of the opening in the container, 22, to be closed. The flange, 21, serves to limit the shearing forces on the balloon exerted by the edges of the container opening as the downward expansion of the membrane occurs.

The hermetically sealed elastic membrane, 9, is held within the closure sidewalls, 2, by its integral flange, 7. The flange, 7, may be a separate element annularly sealed to the hermetically sealed elastic member, or may be formed by merely sealing the walls of the member together to form an annular flange. The hermetically sealed elastic membrane may contain any fluid which does not react with the material from which the membrane is made or would be harmful for human consumption. For example, the membrane could be filled with air or carbon dioxide. The membrane is made of tough but flexible elastic rubber or plastic material, either alone or reinforced with cloth or fibrous, synthetic, or metal strands, or mesh. The surface of the membrane may be smooth or textured.

The actuator plate, 10, rests on the upper surface of the elastic membrane, and is contained completely within the vertical walls, 2, of the closure. The actuator plate is made of either plastic or lightweight metal as is the other part of the closure. The major portion of the upper surface of the actuator plate, 10, forms a depression, 11, which may or may not be roughened. The depression, 11, serves to receive the thumb or finger of the user of the device in operation. The actuator plate is of generally the same shape as the cavity defined by the upper walls, 2, but the plate is somewhat shorter. The difference in the dimensions between the actuator plate and the cavity provide for horizontal movement of the actuator plate to engage and disengage locking means, such as ribs, 13, formed on the inside of upper walls, 2. The locking means engage an extended planar portion, 14, of actuator, 10, when the actuator plate is moved downwardly to depress the elastic membrane, and moved forward by sliding action.

Figure 4:
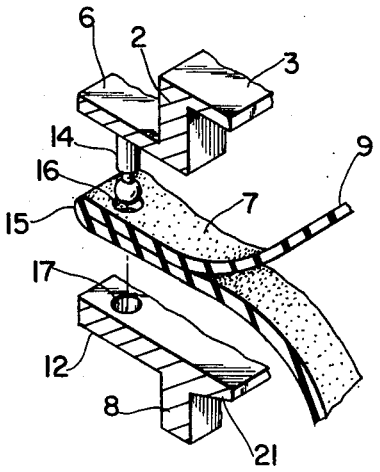
FIG. 4 is an enlarged fragmentary view of a modification of the flange shown in FIG. 1.

In FIG. 4 there is shown a particular modification of the seal, 5. This seal allows the closure to be assembled and disassembled for cleaning or other purposes. Flange, 6, of upper wall, 2, is provided with the male member of the snap fastener. Flange, 7, of elastic membrane, 9, is provided with an aperture through which the male member from the snap fastener passes. Flange, 12, of lower wall, 8, is provided with the female portion of the snap fastener to complete the sealing mechanism. There would be a plurality of these snap fasteners about the flange of the closure.

Figure 5:
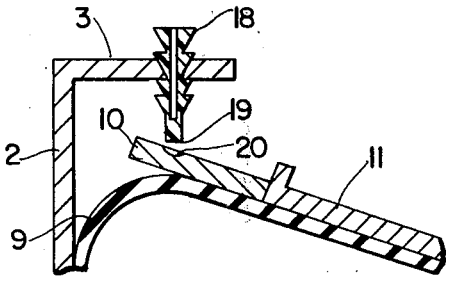
FIG. 5 is an enlarged sectional view of a modification of the actuator plate.

FIG. 5 shows a modification of the locking mechanism by which the actuator, 10, is held in the depressed position. Rather than providing the interior surface of upper wall, 2, with locking means, the locking and positioning of the actuator, 10, may be accomplished through an adjustable locking mechanism, 18, which is inserted through an aperture in the inwardly facing flange, 3, to contact actuator, 10. The locking mechanism, 18, cooperates with flange, 3, by the use of ratchet, or a vertical split shaft ratchet section to depress the actuator, 10, and maintain that depressed position until released. In this modification, member 10 and 4 may be a joined but flexible structure, allowing for vertical motion.

In operation, the user of the device places the closure in contact with the top of a container to be resealed with the elastic member centered over the container opening. While holding the body of the closure with one hand, the actuator is depressed with the other hand. Once the actuator is depressed it is then moved horizontally to engage the locking mechanism. As the actuator moves downwardly under the force of the user's finger the elastic membrane is further everted through the opening formed by the flange, 12, through the opening in the container, then expands to its final preformed shape inside the container. The unconfined shape and size of the elastic membrane in the unconfined space of the container is greater than the size of the opening through which it has been compressed, thereby creating a surface seal about the opening.

Other modifications of the closure described would include for example, the flanges, 6 or 12, or both, being made of stiff resilient material of a size and shape to fit within an upstanding rim of a pop top can, providing greater frictional forces to the resealed closure. Another modification would use a frictional fit between a portion of the rim of the container and the edge of the opening.

While there have been shown and described what are considered to be the preferred embodiments of the invention, it should, of course, be understood that changes in form could readily be made without departing from the spirit of the invention. It is intended, therefore, that the invention be not limited to the exact forms herein shown and described, or to anything less than the whole of the invention as hereinafter claimed.

What is claimed is:

1. An inflated closure for use with a container having a planar end with a permanently formed aperature therein, comprising an inflated hermetically sealed elastic membrane having an annular flange, a housing having an upper body portion and a lower body portion, said lower body portion adapted to contact said container, said housing forming a chamber within which said membrane is disposed, said membrane, said upper body portion and said lower body portion all joined together through said annular flange, said upper body portion of said housing having at one end thereof an inturned continuous flange, an actuator plate of slightly less planar dimensions than said housing located between one surface of said membrane and said inturned flange, and locking means located on said upper body portion within said chamber whereby a container can be resealed by applying downward force to said actuator which everts said membrane from said housing into the cavity within said container and by horizontal motion of said actuator, said locking mechanism is engaged to maintain said actuator in the downward position.

2. The inflated closure of claim 1, wherein said locking means comprises a plurality of vertically spaced downwardly sloping projections formed on the interior surface of said upper body portion.

3. The inflated closure of claim 1, wherein said lower body portion has a vertical end wall defining a tube slightly larger than the opening to be sealed and a horizontal end wall defining an end wall of said chamber, said horizontal end wall having an opening of slightly smaller dimensions than said tube and the opening to be sealed whereby the opening in the horizontal end wall serves as a guide for said membrane.

4. The inflated closure of claim 1, comprising a hinge means engaging one edge portion of said actuator plate on the interior wall of said housing opposite said locking means.

5. The inflated closure of claim 1, wherein said upper body portion and said lower body portion each have interconnected opposed annular flanges with the annular flange of said membrane interposed therebetween.

6. The inflated closure of claim 1, wherein said annular flanges are of such dimensions to provide a snap-fit with the periphery of the container to be sealed

7. The inflated closure of claim 1, wherein said locking means comprises an aperture in said continuous inturned flange and a ratchet means extending through said aperture into said chamber, one end of said ratchet means contacting said actuator plate, the other end of said ratchet means extending above said housing whereby said actuator plate may be moved and locked in incremental steps progressively everting said membrane from said housing.

* * * * *